United States Patent [19]

Kühn

[11] 4,371,042

[45] Feb. 1, 1983

[54] FLUID OPERATED RAM

[75] Inventor: Hans Kühn, Hamburg, Fed. Rep. of Germany

[73] Assignee: Koehring GmbH, Hamburg, Fed. Rep. of Germany

[21] Appl. No.: 103,521

[22] Filed: Dec. 31, 1979

[30] Foreign Application Priority Data

Jan. 4, 1979 [DE] Fed. Rep. of Germany ..... 2900221

[51] Int. Cl.[3] ..... B25D 9/00; E21B 1/00

[52] U.S. Cl. ..... 173/127; 91/308; 91/341 R

[58] Field of Search ..... 173/127; 91/308, 341 R

[56] References Cited

U.S. PATENT DOCUMENTS

| | | | |
|---|---|---|---|
| 3,892,279 | 7/1975 | Amtsberg | 173/127 |
| 3,935,908 | 2/1976 | Pepe | 173/127 |
| 4,043,405 | 8/1977 | Kuhn | 173/127 |

FOREIGN PATENT DOCUMENTS

| | | | |
|---|---|---|---|
| 550282 | 3/1931 | Fed. Rep. of Germany | 91/341 |
| 1634298 | 5/1973 | Fed. Rep. of Germany . | |

*Primary Examiner*—Werner H. Schroeder
*Assistant Examiner*—Andrew M. Falik
*Attorney, Agent, or Firm*—Michael J. Striker

[57] ABSTRACT

A fluid operated ram comprises a striker body guided in an upright housing between an active stroke and a return stroke and striking at the end of its active stroke an impact transmitter resting on a member to be driven into the ground by the ram. The striker body is connected by a piston rod to a working piston reciprocatedly arranged in a cylinder coaxially mounted on the upper end of the housing, so that the striker body is driven during reciprocation of the working piston. The working piston is a differential piston and divides the cylinder into a first chamber above the upper larger face of the working piston and a second chamber below the smaller annular face of the differential piston. The second chamber permanently communicates with a source of pressure fluid, while control elements, including an axially movable valve slide and a valve rod cooperating therewith, serve to alternately connect the first chamber to the source of pressure fluid or a tank in dependence on the position of the striker body in the housing. The length of the valve rod is dimensioned so that the lower end thereof engages a contact face on the working piston during the downward movement of the latter together with the striker body, but is disengaged from the contact face shortly before the striker body hits the impact transmitter so that the resulting blow is not transmitted to the valve rod and the other control elements.

24 Claims, 3 Drawing Figures

FLUID OPERATED RAM

BACKGROUND OF THE INVENTION

The present invention relates to a fluid-operated ram comprising a housing, an axially guided striker body, a pressure fluid cylinder arranged on the housing or in the striker body, coaxially with respect thereto and divided by a working piston reciprocably arranged in the cylinder in a first and a second chamber. A piston rod connects the working piston with the striker body within the housing. Passage means connect both chambers of the cylinder with a source of pressure fluid and at least the first chamber, which increases in volume the movement of the striker body during its active stroke is associated with a tank for receiving the pressure fluid. The ram comprises further control devices including a valve slide limitedly movable in the housing coaxial to the piston rod between a first position in which at least one chamber of the cylinder is connected with a source of pressure fluid and a second position connecting the chamber with the tank for receiving the pressure fluid and devices for moving the valve slide to the second position dependent on the position of the striker body.

Such a ram is disclosed in the German Auslegungsschrift 1,634,298. This ram has a pressure fluid filled space in the piston rod, a hollow fluid-filled plunger piston coaxially guided through the working piston and extending into the hollow space in the piston rod and reversing the valve slide in dependence on the movement of the working piston. For this purpose the hollow space in the piston rod is connected over the plunger piston and passages in the housing with two storage cylinders, subdivided by a movable piston and over the working piston and bores, opened only in the lower end position of the working piston, with the upper chamber of the cylinder. Thereby, the fluid enclosed in the hollow of the piston rod and of the plunger piston will, during upward movement of the working piston, reverse the valve slide against the pressure force acting permanently on the upper end of the latter. This known construction has, however, the disadvantage that the plunger piston, which is integrally connected with the valve slide, is permanently in contact with the working piston so that blows occurring during the active stroke of the striker body on the latter are transmitted to the working piston fixedly connected to the striker body and thereby transmitted to the sensitive control devices which will lead to undesired vibrations and break down of the latter. Since the size of the control devices is not correspondingly increased at increasing size of the ram, the control devices are relatively small, fragile parts, so that such blows onto the control devices will be the more damaging the greater the ram is dimensioned. Since in the above-mentioned known ram the plunger piston serving as valve slide is built into the pressure fluid cylinder and the working piston and since the remaining control elements and connecting channels are integrated in the housing of the ram, it is necessary during operating trouble to bring the whole ram into the work shop and there disassemble the same. This is evidently expensive and time consuming with rams of large size.

While fluid operated rams are also known in the art in which the control devices are arranged spaced from the housing of the ram and respectively connected to the latter by pressure fluid conduits, these known rams have the disadvantage of requiring long fluid pressure conduits from the control devices to the cylinder and that the connection of the fluid pressure conduits to the control devices and to the housing of the ram may be loosened by vibration, which is especially detrimental at off-shore operation of the ram in which the ram is located under water.

SUMMARY OF THE INVENTION

It is therefore an object of the present invention to provide a ram of the above-mentioned type which avoids the disadvantages of such rams known in the art. It is a further object of the present invention to provide a ram in which the blows occurring during operation of the ram are not transmitted to the control device of the latter.

With these and other objects in view, which will become apparent as the description proceeds, the fluid operated ram according to the present invention mainly comprises an upright housing having an axis, a striker body guided in said housing for reciprocation along said axis between an active stroke and a return stroke, an impact transmitter between the striker body and a member to be driven by the ram into the ground arranged to be hit by the striker body at the end of its active stroke, a cylinder disposed at the upper end of the housing coaxially therewith, a working piston reciprocably arranged in the cylinder and dividing the latter in a first and a second chamber, a piston rod connecting said working piston with the striker body for simultaneous movement, a source of pressure fluid, a tank for the pressure fluid, passage means connecting the first and the second chamber with the source of pressure fluid and connecting the first chamber to the tank, control means comprising valve slide means cooperating with said passage means and being movable between a first position connecting at least one of said chambers with said source of pressure fluid and a second position connecting said first chamber with the tank. The valve slide means is formed with an axial bore having an open end facing said working piston. The ram includes further means for moving said valve slide means to said second position in dependence on the position of the striker body and comprises a valve rod axially guided in said bore of said valve slide means and having an end portion projecting into said first chamber, means cooperating with said valve rod for biasing the same toward said working piston, and means for limiting axial movement of said valve slide means and said valve rod relative to each other. The valve rod has a free end in the first chamber and the working piston has a contact face opposite the free end of the valve rod. The length of the valve rod is dimensioned so that as long as the striker body during its active stroke is spaced a predetermined distance or more from the impact transmitter, the free end of the valve rod remains in contact with the contact face and so that when the striker body is spaced from the impact transmitter a distance smaller than said predetermined distance the free end of the valve rod is disengaged from the contact face.

Since during impact of the striker body onto the impact transmitter the valve rod is disengaged from the contact surface on the working piston, which in turn is fixedly connected by the piston rod to the striker body, blows imparted to the striker body will not be transmitted to the valve slide. Nevertheless, the valve rod will assure a reversal of the valve slide in dependence on the respective position of the striker body.

Preferably the working piston is a differential piston having a larger piston surface facing the first chamber and a smaller piston surface facing the second chamber and the aforementioned passage means permanetly connect the second chamber with the source of pressure fluid. The valve slide connects in the first position the first chamber with the source of pressure fluid so that in the first position of the valve slide the first chamber communicates with the second chamber.

The valve slide is arranged for reciprocation in an axial bore of a control housing located in a portion of the cylinder which faces away from the striker body and the axial bore has an open end communicating with the first chamber and an opposite closed end. The arrangement includes further spring means abutting with opposite ends against the closed end of the bore and the end of the valve slide facing the closed end for biasing the valve slide to the second position.

The control housing is removably arranged in the aforementioned portion of the cylinder so as to be easily removable therefrom for repair purposes, without the necessity of transporting the whole ram to a workshop. In this way any eventually necessary repairs of the control housing and the elements mounted therein can be easily carried out without the necessity of transporting the whole ram to a workshop. Since the control devices of the ram of the present invention are protected from shocks, operating troubles will occur in the control devices very rarely and the same may be eventually easily removed from the remainder of the ram and exchanged against new control devices, so that longer idle times for the ram may be prevented, which is especially advantageous during use of the ram in offshore operations.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
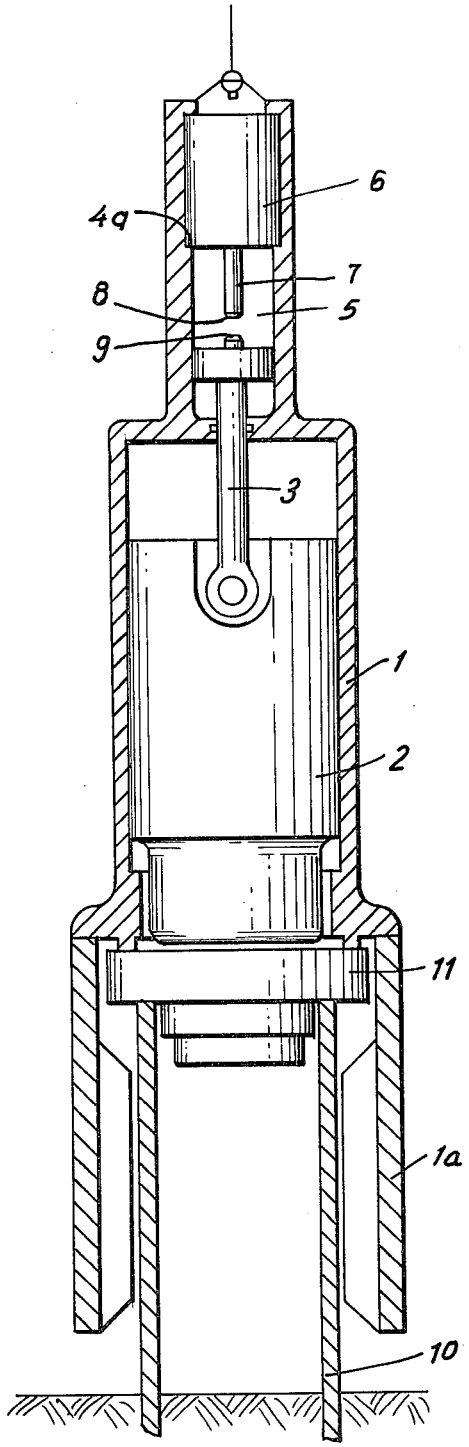
FIG. 1 is a schematic longitudinal section through the ram according to the present invention.

Referring now to the drawing, and more specifically to FIG. 1 of the same, it will be seen that the ram according to the present invention comprises a substantially cylindrical housing 1, in which a likewise cylindrical striker body 2 is guided for reciprocation along the axis of the housing 1 between an active stroke and a return stroke. A piston rod 3 is pivotally connected at the lower end thereof to the striker body 2 and passes through an opening in the upper closed end of the housing 1 to be connected at its opposite end to a working piston 3*a* which is guided for reciprocation in a cylinder 4 projecting upwardly from the upper end of the housing 1, coaxially with the latter. A control housing 6 is removably arranged, in a manner as will be described later on, in an upper portion of the cylinder 4 and a valve rod 7 projects from the control housing 6 into a chamber 5 formed in the cylinder 4 above the working piston 3*a* arranged therein. The part-spherical formed lower end face 8 of the valve rod 7 cooperates with a likewise part-spherical contact surface 9 projecting from the upper surface of the working piston 3*a*, A guide sleeve 1*a* is connected to the lower end of the housing 1 for guiding a member 10 which has to be driven by the ram into the ground. The housing abuts with its lower end thereof against the upper surface of an impact transmitter 11, resting in turn on the upper end of the member 10. At the end of the working stroke of the striker body 2 the latter hits against the upper surface of the impact transmitter 11, so that the blow imparted by the striker body 2 is transmitted through the impact transmitter to the member 10.

Figure 2:
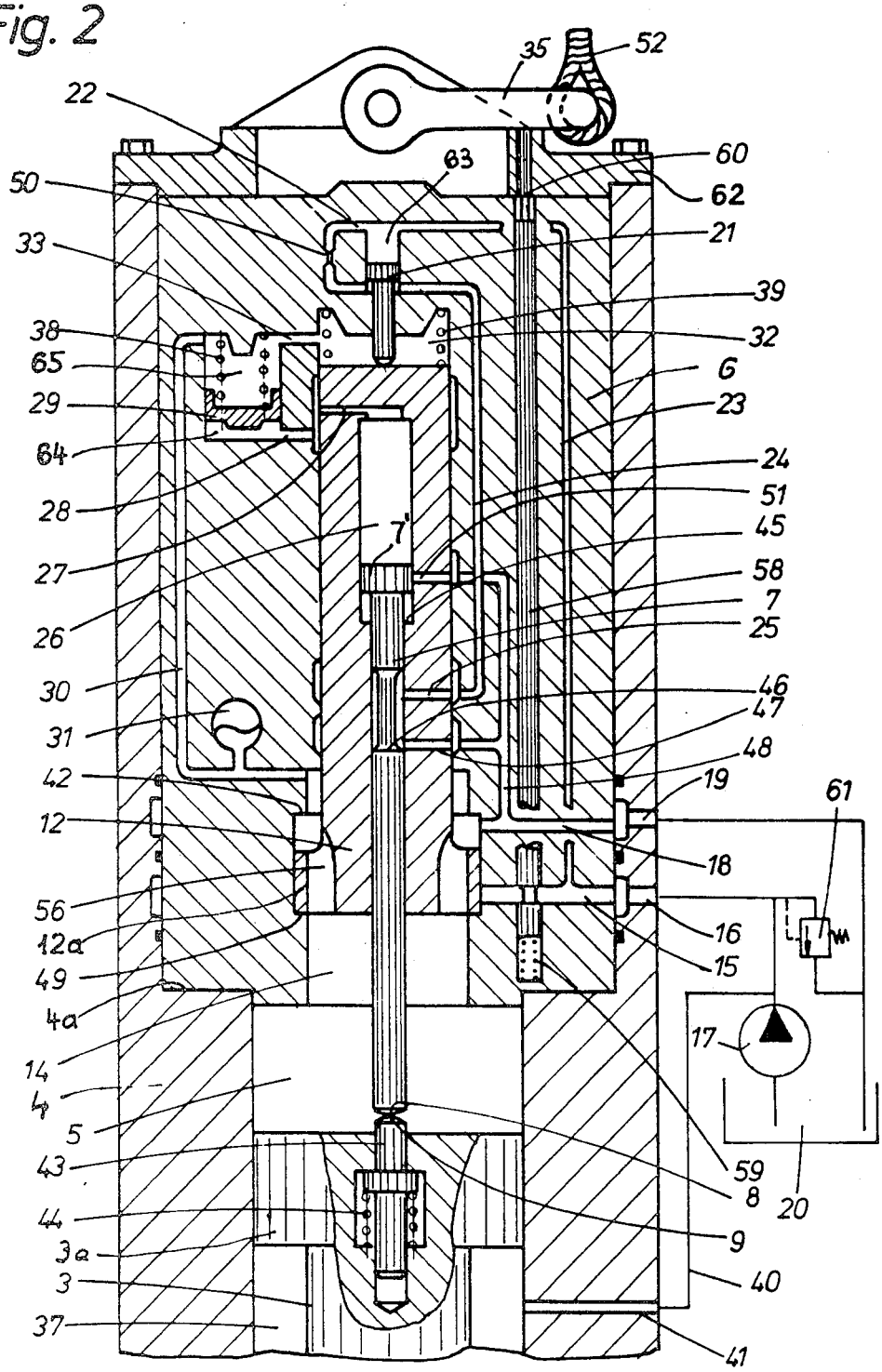
FIG. 2 is a longitudinal cross section at an enlarged scale through the portion of the ram containing the control housing and the elements mounted therein.

As shown in FIG. 2 the ram is connected by means of a shackle 35 pivotably mounted on a cover 62, which in turn is removably connected by screws to the upper open end of the cylinder 4, with a carrying rope 52 of a nonillustrated crane, so that the whole ram may be lifted. In the working position of the ram in which the housing 1 rests on the impact transmitter 11, as shown in FIG. 1, the carrying rope is limp so that the shackle 35 under its own weight rests on the cover 62 as shown in FIG. 2.

As further shown in FIG. 2, the cylinder 4 has an upper portion of larger diameter than a lower portion in which the working piston 3*a* is guided, to form between the two portions a shoulder 4*a* and a substantially cylindrical control housing 6 is arranged in the upper portion of the cylinder 4 abutting with opposite ends respectively against the shoulder 4*a* and the cover 62 at the upper end of the cylinder, so that the control housing 6 may easily be removed from the cylinder 4 by removing the cover 62 therefrom. The control housing 6 is formed with a bore therethrough coaxial with the axis of the housing 1 and the bore has a lower open end 14 communicating with the chamber 5 above the working piston 3*a* and an opposite closed end. The piston rod 3 forms together with the working piston 3*a* at its upper end a differential piston having an upper piston surface facing the chamber 5, thereafter called first chamber, whereas the lower annular piston surface faces a second chamber 37 located below the working piston 3*a*. The second chamber 37 is permanently connected through a pressure channel 41 and a pressure conduit 40 to the pressure side of a pump 17, pumping hydraulic fluid from a tank 20.

Figure 3:
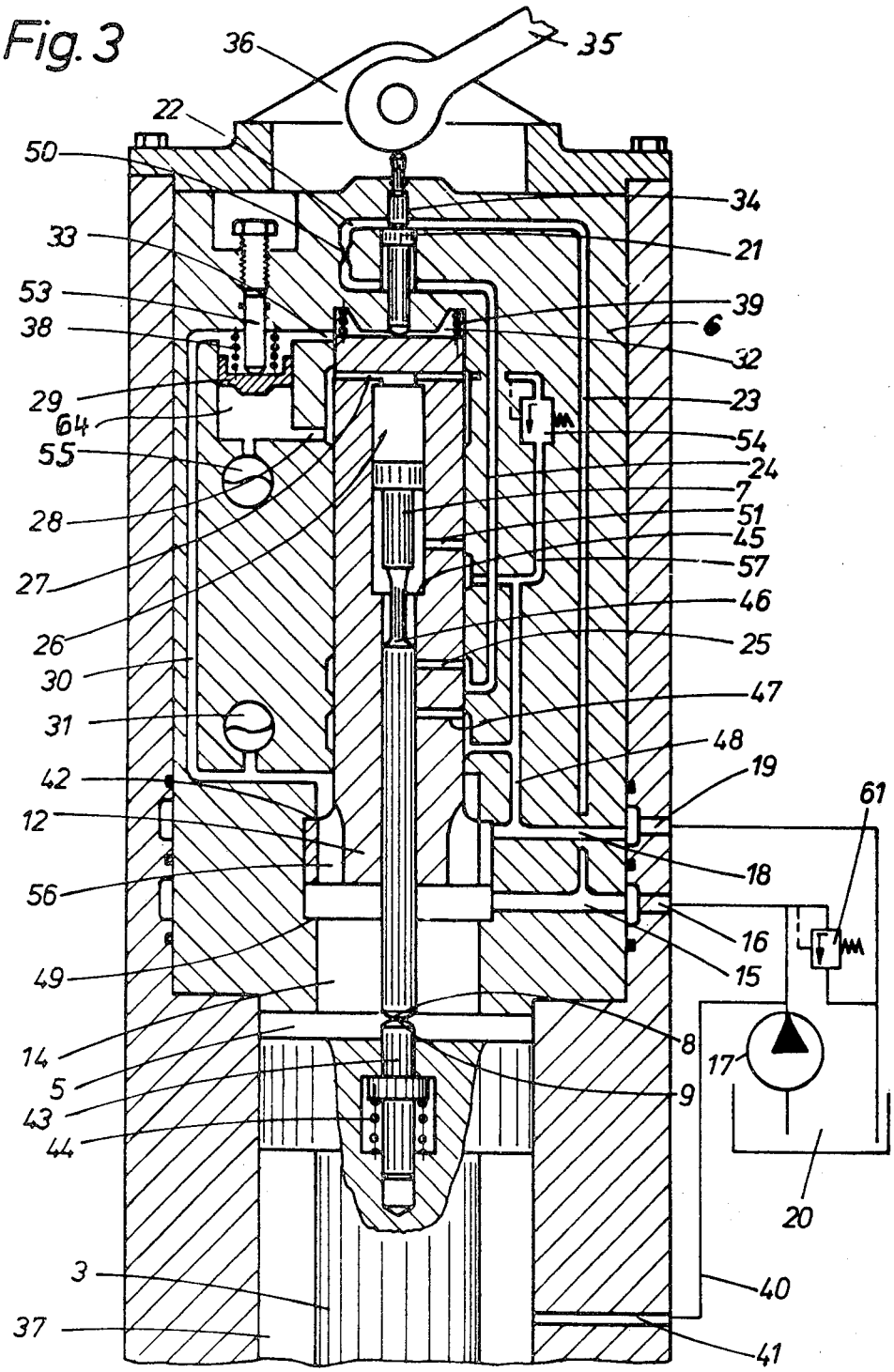
FIG. 3 is a longitudinal section similar to that shown in FIG. 2 and showing a slightly modified control arrangement.

A substantially cylindrical valve slide 12 is guided in the axial bore of the control housing 6 for limited movement in axial direction. The valve slide 12 is provided at its end thereof directed toward the first chamber 5 with a radially outwardly extending annular shoulder 12*a* in which through flow channels 56 are arranged. The axial bore through the control housing 6 is provided with a pair of axially spaced annular shoulders 42 and 49 respectively limiting a larger diameter portion of the bore. The large diameter portion of the bore through the control housing communicates adjacent the annular shoulder 49 through a channel 16 through the wall of the cylinder 4 and a pressure fluid inlet channel 15 through the control housing with the pressure pump 17 and through a channel 19 in the cylinder 4 and an outlet channel 18 through the control housing 6 adjacent the shoulder 42 with the tank 20. The annular shoulder 12*a* of the valve slide 12 sealingly engages with its outer surface the inner surface of the bore through the control housing 6 between the shoulders 42 and 49 and the annular shoulder 12*a* of the valve slide 12 is movable between a first position abutting with its upper end against the annular shoulder 42 closing thereby the outlet channel 18 while opening the fluid pressure inlet channel 15 and a second position, as shown in FIG. 2 in which the annular shoulder 12*a* abuts with its lower end against the shoulder 49, closing thereby the pressure fluid inlet channel 15, while opening the outlet channel 18. In the second position of the valve slide 12, as shown in FIG. 2, the first chamber 5 of the cylinder 4 is connected over the opening 14, the flow-through channels 56 and the outlet channel 18 with the tank 20, from which the pump 17 pumps pressure fluid. Since at the same time the second chamber 37 of the cylinder 4 is connected over the pressure channel 41 and the pressure conduit 40 permanently with the pressure side of the pump 17, the working piston 3*a* is moved upwardly, whereby the pressure fluid in the first chamber 5 passes to the tank 20 and the striker body 2 is moved in upward direction. In the first position of the valve slide 12, as shown in FIG. 3, the first chamber 5 is connected through the opening 14, the pressure fluid channel 15, and the channel 16 communicating therewith, with the pressure side of the pump 17 so that the working piston 3*a*, due to the pressure acting on the upper larger surface of the working piston, moves downwardly. The pressure fluid thereby displaced from the second chamber 37 can flow through the pressure channel 41, the pressure conduit 40, the channel 16, the pressure fluid inlet channel 15 and the opening 14 into the first chamber 5, so that the pump 17 has to feed into the first chamber 5 only a volume which corresponds to the product of the cross section of the piston rod 3 and the stroke of the latter.

A pressure fluid space 32 is arranged in the illustrated embodiment in the control housing 6 between the upper end of the valve slide 12 and the closed end of the bore in the control housing 6. The pressure fluid space 32 permanently communicates over connecting channels 30 and 33 formed in the control housing 6 and the flow through channels 56 in the valve slide with the opening 14 and the first chamber 5. A coil compression spring 39 is arranged in the pressure fluid space 32 abutting with opposite ends against the upper end of the valve slide 12 and the upper end wall in the control housing 6. A pressure fluid accumulator 31 with a prestressed gas pillow, separated from the pressure fluid by a membrane, communicates with the connecting channel 30 for receiving excess pressure fluid and for smoothing pressure fluid streams. A control piston 21 of small diameter, constructed as a stepped piston abuts further against the upper surface of the valve slide 12. The control piston 21 is guided for reciprocation in a corresponding stepped cylinder 63 arranged coaxial with the valve slide 12. The chamber in the cylinder 63 which faces away from the valve slide 12 is permanently connected through fluid pressure channels 22 and 23 with the pressure fluid inlet channel 15 connected to the pump 17. The chamber of the cylinder 63 which borders the annular piston surface of the control piston 21 facing the valve slide 12 is connected, on one hand, over a throttle 50 with the fluid pressure channel 22 and on the other hand over the connecting channels 24 and 48 and a stop member cooperating therewith with the outlet channel 18 leading to the tank 20.

The valve slide 12 is further provided with a coaxial guide bore having a lower open end, whereas the upper section of this bore is formed as a cylinder space 26. A valve rod 7 is axially guided in the aforementioned bore. The valve rod 7 is provided at its upper end with a piston 7' which is fluid-tightly guided in the cylinder space 26. The upper end of the cylinder space 26 is connected through a channel 27 in the valve slide 12 and a further connecting channel 28 in the control housing 6 communicating therewith with one compartment 64 of a cylinder formed in the valve housing 6. A separating piston 29 in the cylinder separates the compartment 64 from the other compartment 65 of the cylinder which is connected to the connecting channels 30 and 33. The compartment 65 contains a coil compression spring 38 biasing the separating piston 29 in a sense to reduce the compartment 64. During an upwards movement of the valve rod 7 relative to the valve slide 12, the separating piston 29 is moved by the pressure fluid displaced from the cylinder space 26, against the force of the coil compression spring 38, in upward direction. This movement may be limited by an abutment, which may be adjustable as for instance shown in the embodiment illustrated in FIG. 3.

The valve rod 7 is provided in the section thereof which is fluid-tightly guided in the bore of the valve slide 12 with an annular cutout 46, which at a predetermined position of the valve rod 7 relative to the valve slide 12 connects the two axially displaced transverse channels 25 and 47 formed in the valve slide, which in turn respectively permanently communicate with the connecting channels 24 and 48 in the control housing 6.

The valve slide 12 is further provided with an additional transverse channel 51 having an inner end communicating with the cylinder space 26 and an outer end permanently communicating with the connecting channel 48. The inner end of the transverse channel 51 is either closed by the piston 7' at the upper end of the valve rod 7 or when the latter moves downwardly relative to the valve slide 12 toward the abutment shoulder 45 of the cylinder space 26 with the portion of the latter above the piston 7', or during upward movement with the annular space between the piston 7' and the shoulder 45.

The working piston 3*a* is provided with a coaxial plunger 43 arranged for limited axial movement against a coil compression spring 44 in a corresponding bore of the working piston 3*a*. The plunger 43 is provided at its end projecting beyond the upper face of the working piston 3*a* with a part spherical contact surface 9 cooperating with a corresponding surface 8 at the lower end of the valve rod 7.

A rod-shaped stop valve 58 is axially guided in a bore of the control housing 6 extending parallel to the valve slide 12. The rod-shaped stop valve 58, provided adjacent its lower end with an annular cutout, passes through the pressure fluid inlet channel 15 and is biased by a coil compression spring 59 engaging its lower end into a closing position, preventing pressure fluid to pass through the pressure fluid inlet channel 15. The upward movement of the rod-shaped stop valve 58 is limited by shoulder 60 adapted to abut against the cover 62. In its blocking position the rod-shaped stop valve 58 projects with its upper end a small distance beyond the cover 62, but during working of the ram, in which the housing 1 of the same rests on the impact transmitter 11 and the latter on the element 10, the carrying rope 52 will be limp and the upper end of the stop valve 58 will be engaged by the shackle 35 and held by the weight of the latter against the force of the compression spring 59 in opening position, as shown in FIG. 2, in which the annular cutout is located in the channel 15 so that pressure fluid may pass through this channel.

FIG. 3 illustrates a slightly modified ram according to the present invention. In the construction of the ram, as shown in FIG. 3, a stop piston 34 operable by an eccentric on the shackle 35 is provided instead of the rod-shaped stop valve 58. The stop piston 34 is, during lifting of the ram and the therewith by the carrying rope 52 lifted shackle 35 and the eccentric 36 of the latter, moved downwardly together with the control piston 21 for a distance to move the valve slide 12 thereby to the position as shown in FIG. 2, in which the first chamber 5 communicates with the tank 20, and blocks the valve slide 12 in this position. In order to limit the maximum stroke of the separating piston 29 to an adjustable distance, there is further provided a set screw 53 against which the separating piston 29 will abut sooner or later depending on the position of the set screw. This will correspondingly change, during upward movement of the valve rod 7, the amount of reversal of the valve slide 12 and therewith the stroke of the working piston 3*a*. In order to prevent a destruction of the valve rod 7 at a small stroke of the separating piston 29 at a corresponding adjustment of the set screw 53 and the movement of the stop piston 34 to its stopping position, there is further provided a connecting channel 57 which leads from the upper end of the cylinder space 26 to the connecting channel 48 and in which a safety valve 54 is provided. There is further provided an additional pressure fluid accumulator 55, communicating with the compartment 64.

The length of the valve rod 7 is determined in such a manner that the end face 8 of the same abuts against the contact surface 9 of the plunger 43 as long as the lower end of the striker body 2 is located a distance greater than a predetermined minimum distance above the upper face of the impact transmitter 11. During downward movement of the striker body 2 beyond this minimum distance, the piston 7' on the upper end of the valve rod 7 will abut against the shoulder 45 at the lower end of the cylinder space 26 or against a pressure fluid pillow between the piston 7' and the shoulder 45 so that the end face 8 will be lifted from the contact surface 9. Thereby the valve rod 7 will not engage with the plunger 43 at the moment the striker body 2 hits the impact transmitter 11. By correspondingly dimensioning the length of the valve rod 7 it is possible to adjust the moment at which the lower end face 8 of the valve rod 7 comes again in contact with the contact surface 9 that even at a rebound of the striker body 2 upon hitting the impact transmitter 11 the two surfaces 8 and 9 will not engage with each other. In order to adjust the moment of disengagement of the end face 8 from the contact surface 9 it is possible to make the length of the valve rod 7 and/or of the plunger 43 adjustable in a known, not illustrated manner.

In the position of the various elements as shown in FIG. 2 the working piston 3*a* is lifted due to the pressure fluid pressed by the pump 17 over the pressure conduit 40 and the pressure channel 41 into the second chamber 37 and simultaneously pressure fluid is discharged from the first chamber 5 over the outlet channel 18 and the channel 19 to the tank 20. While at the start of this upward movement of the working piston 3*a* the end face 8 of the valve rod 7 was lifted from the contact surfaces 9, the end face 8 and the contact surface 9 engage now each other so that the valve rod 7 is moved upwardly to displace thereby pressure fluid from the cylinder space 26 through the channel 27 and the connecting channel 28 into the compartment 64, to thereby move the separating piston 29 against the force of the compression spring 38 in upward direction until the separating piston 29 engages with the abutment projecting into the compartment 65. At this moment further pressure fluid cannot any longer be discharged from the cylinder space 26 above the piston 7', so that a high pressure will develop in the cylinder space 26, whereby the valve slide 12 is moved upwardly against the force of the compression spring 39 and the force of the fluid pressure acting on the control piston 21, until the ring shoulder 12*a* of the valve slide 12 abuts with its upper surface against the annular shoulder 42, to thereby close the outlet channel 18, while opening the pressure fluid inlet channel 15. The upward movement of the working piston 3*a* is thereby first braked through the pressure fluid passing from the pump 17 over the channel 16 and the pressure fluid inlet channel 15 and the opening 14 in the first chamber 5 and subsequently the working piston 3*a* will be moved in downward direction. Since the working piston 3*a* due to its inertia will move still further upward after the valve slide 12 has reached the position as shown in FIG. 3, while the valve rod 7 without an additional safety valve cannot move further upwardly, there is provided by the plunger 43, which is upwardly urged by the compression spring 44, an additional adjusting stroke for which, however, a higher operating force is necessary than for the upward movement of the valve slide 12.

The fluid contained in the pressure fluid space 32 is, during upward movement of the valve slide 12 displaced over the connecting channels 33 and 30 into the prestressed pressure fluid accumulator 31. The pressure fluid accumulator 31 receives also the surplus pressure fluid which after closing of the pressure fluid inlet channel 18 cannot flow any longer from the first chamber 5 into the tank 20, to thereby avoid dangerous pressure surges.

When now the working piston 3*a* moves downwardly after the valve slide 12 and the valve rod 7 are in the position as shown in FIG. 3, the pressure fluid accumulator 31 will first be discharged. The spring force acting together with the overpressure in the compartment 65 on the separating piston 29 will move the latter now downwardly to displace pressure fluid from the compartment 64 into the cylinder space 26 to act on the piston 7' on the upper end of the valve rod 7 to move the latter downwardly as the working piston 3*a* moves also in downward direction so that the end face 8 of the valve rod 7 will be held in abutment with the contact face 9 until the piston 7' of the valve rod 7 is prevented from a further downward movement by engagement with the shoulder 45. The valve rod 7 remains now at a standstill so that the end face 8 disengages the contact surface 9, while the working piston 3*a* moves further downwardly until the striker body 2 hits the impact transmitter 11.

During the downward movement of the valve rod 7, the control edge of the cutout 46 therein moves beyond the transverse channels 25 and 47 so that the space beneath the bottom face of the control piston 21 is connected over the channels 24, 25, 47, 48 and 18 with the tank 20. Since at the same time the pressure fluid pumped by the pump 17 acts also in channels 15, 16 and 23 on the upper surface of the control piston 21, the latter and therewith the valve slide 12 are pressed downwardly until the annular shoulder 12*a* of the valve slide 12 abuts against the shoulder 49 of the valve housing 6 to open thereby the outlet channel 18 while closing at the same time the pressure fluid inlet channel 15. Since the pressure fluid channel 23 is connected over the throttle 50 with the connecting channel 24 the pump pressure will again be obtained in the connecting channel 24 and in the space beneath the control piston 21 so that the control piston 21 in the phase of the next downward movement of the working piston 3*a*, in which also an overpressure remains in the pressure fluid space 32 will be neutralized, which will facilitate the already described reversing movement of the valve slide 12 in upward direction.

When the valve slide 12 with its ring shoulder 12*a* abuts against the annular shoulder 42 it will be held in this position until activation of the control piston 21 by a force resulting from a non-illustrated difference surface on the ring shoulder 12*a*. If pressure fluid escapes due to leakage losses from the cylinder space 26, such pressure fluid may be replenished after each operating cycle when the piston 7' of the valve rod 7 surpasses the channel 51 and establishes such a connection to the connecting channel 48 from which the lost pressure fluid may be sucked.

The rod-shaped stop valve 58 provided in the embodiment illustrated in FIG. 2, respectively the stop piston 34 provided in the embodiment according to FIG. 3, assure during an inadvertent lifting of the ram from the element 10 by tensioning of the carrying rope 52 and lifting of the shackle 35 an automatic closure of the pressure fluid inlet channel 15, respectively a blocking of the valve slide 12 which is moved downwardly by the stop piston 34 over the control piston 21. The downward pressure of the stop piston 34 is performd in the embodiment shown in FIG. 3 by the cam curve on the eccentric 36. Thereby it is assured that the working piston 3*a* and the striker body 2 can be moved upwardly only so far until the striker body 2 engages the upper end of the housing 1. A downward movement of the striker body 2 cannot take place any longer because the pressure fluid inlet channel 15 for introduction of pressure fluid from the pump 17 to the first chamber 5 is not opened any more.

In the embodiment shown in FIG. 3, in which an adjusting screw 53 cooperates with the separating piston 29, a safety valve 54 is necessary in view of the automatic disconnection during lifting of the ram from the member 10, since when a small upward stroke of the separating piston 29 is preset by the adjusting screw 53, and the stop member 34 or 58, respectively, is in its locking position, due to non-moving control piston 21, the valve rod 7 would still be moved in upward direction by the working piston 3*a* impinged at its bottom face by pressure fluid, when the separating piston 29 abuts already against the set screw 53 and the plunger 43 is moved to its lowermost position against the force of the compression spring 44. In this case the valve rod 7 would be destroyed if pressure fluid could not flow out from the cylinder space 26 through the safety valve 54 and the channels 57 and 48. It is mentioned that the adjustment of the upper stroke of the separating piston 29 cannot only be provided by the set screw 53 as shown in FIG. 3, but also by hydraulic, by electric or electric-hydraulic actuated adjusting piston.

In addition, or instead of the spring pressed plunger 43 there may also be used an additional prestressed fluid accumulator 55 communicating with the compartment 64, as shown in FIG. 3, which during upward movement of the working piston 3*a* and corresponding upward movement of the valve rod 7 will receive pressure fluid displaced from the cylinder space 26. If this additional pressure fluid accumulator 55 is dimensioned large enough, the safety valve 54 may be omitted.

Since in the ram according to the present invention all control elements are arranged in the control housing 6, which has only few perfectly sealable outer connecting openings, the ram of the present invention is especially adapted for use under water. At the same time the construction of the present invention greatly facilitates the disassembly or exchange of the compact control housing for repair or maintenance purpose.

It will be understood that each of the elements described above, or two or more together, may also find a useful application in other types of fluid operated rams differing from the types described above.

While the invention has been illustrated and described as embodied in a fluid operated ram, it is not intended to be limited to the details shown, since various modifications and structural changes may be made without departing in any way from the spirit of the present invention.

While the construction of the ram according to the present invention is especially suitable for large rams to be used in offshore operations, it can eventually also in simplified form be used for smaller rams, for work on land. Thereby it is also possible to move the valve slide 12 only by spring force or through the kinetic energy of the downwardly moving valve rod into the position in which the first chamber 5 of the cylinder 4 is connected with the tank 20.

Without further analysis, the foregoing will so fully reveal the gist of the present invention that others can, by applying current knowledge, readily adapt it for various applications without emitting features that, from the standpoint of prior art, fairly constitute essential characteristics of the generic or specific aspects of this invention.

What is claimed as new and desired to be protected by Letters Patent is set forth in the appended claims:

1. A fluid operated ram for driving a member into the ground, comprising an upright housing having an axis; a striker body guided in said housing for reciprocation along said axis between an active stroke and a return stroke; an impact transmitter between said striker body and the member to be driven into the ground upon striking of the striker body against said impact transmitter; a cylinder disposed at the upper end of the housing coaxially therewith; a working piston reciprocable arranged in said cylinder and dividing the latter into a first and a second chamber; a piston rod connecting said working piston with said striker body for simultaneous movement in axial direction; first passage means for connecting said first and said second chamber with a source of pressure fluid and second passage means for connecting said first chamber to a space for released fluid; control means comprising a valve slide means cooperating with said first and second passage means and being movable coaxial with said piston rod between a first position connecting at least one chamber with said first passage means and a second position connecting said first chamber with said second passage means, said valve slide means being formed with an axial bore having an open end facing said working piston; means for moving said valve slide means to said second position in dependence on the position of the striker body relative to said housing and comprising a valve rod axially guided in said bore of said valve slide means and having an end portion projecting into said first chamber, means cooperating with said valve rod for biasing the same toward said working piston, and means for limiting axial movement of said valve slide means and said valve rod relative to each other, said valve rod having a free end in said first chamber and said working piston having a contact face opposite said free end of said valve rod, the valve rod having a length adjusted so that when said striker body during its active stroke is spaced at least a predetermined distance from said impact transmitter, said free end of said valve rod abuts against said contact face and when the striker body is spaced from said impact transmitter a distance smaller than said predetermined distance, said free end of said valve rod is disengaged from said contact face; and wherein said working piston is a differential piston having a larger piston surface facing said first chamber and a smaller piston surface facing said second chamber and wherein said passage means permanently connects said second chamber with said source of pressure fluid.

2. A fluid operated ram as defined in claim 1, wherein said valve slide means connects in said first position said first chamber with said source of pressure fluid so that in said first position of said valve slide means said first chamber communicates with said second chamber.

3. A fluid operated ram as defined in claim 2, and including a control housing in an upper portion of said cylinder, said valve slide means being guided in said control housing for movement between said positions thereof.

4. A fluid operated ram as defined in claim 3, wherein said control housing is formed with an axial bore having an open end communicating with said first chamber and an opposite closed end, said valve slide means being guided in said axial bore.

5. A fluid operated ram as defined in claim 3, wherein said control housing is removably mounted in said cylinder.

6. A fluid operated ram as defined in claim 5, wherein said cylinder has adjacent said housing a first portion with an inner cylindrical surface of smaller diameter in which said working piston is guided and distant from said housing a second portion with an inner cylindrical surface of larger diameter to form the junction of said two portions a shoulder, said second portion of said cylinder having distant from said shoulder an open end, and a cover removably mounted over said open end, said control housing being held in said cylinder between said shoulder and said cover.

7. A fluid operated ram as defined in claim 3, and including a small cylinder formed in said control housing coaxially with and adjacent that end of said valve slide means which faces away from said working piston, a control piston slidably guided in said small cylinder and passage means permanently connecting one end of said small cylinder with said source of pressure so that the pressure fluid acts on a face of said control piston to press the end of the latter opposite said face constantly against the face of said valve slide means opposite the end of said control piston.

8. A fluid operated ram as defined in claim 7, wherein said control piston is a stepped piston having an annular face directed toward said valve slide means and forming in said small cylinder an annular space bordering said annular face, and connecting channels connecting said annular space with said tank, shut-off means in said connecting channels, and pressure fluid channels connecting said annular space with said source of pressure fluid, and a throttle in said pressure fluid channels.

9. A fluid operated ram as defined in claim 8, wherein said shut-off means comprises a pair of axially spaced transverse passages through said valve slide means respectively permanently communicating with said connecting channels and a cutout in said valve rod which connects said transverse passages to each other only at a predetermined position of said valve rod relative to said valve slide means.

10. A fluid operated ram as defined in claim 4, and including spring means abutting with opposite ends against said closed end of said bore and the end of said valve slide means facing said closed end for biasing said valve slide means to said second position.

11. A fluid operated ram as defined in claim 4, and including a pressure fluid space between said closed end of said bore and said facing end of said valve slide means and passage means providing communication between said pressure fluid space and said first chamber.

12. A fluid operated ram as defined in claim 4, wherein said first chamber and said open end of said bore are filled with pressure fluid acting against an end face of said valve slide means which is directed towards said working piston.

13. A fluid operated ram as defined in claim 4, and including pressure fluid inlet channel means through said cylinder and said control housing providing in said first position of said valve slide means communication between said first chamber and said source of pressure fluid, stop valve means movable between a first position preventing flow of pressure fluid between said source and said first chamber and a second position permitting such flow, spring means biasing said stop valve means to said first position, and means adapted to cooperate with a lifting device for lifting said ram so as to hold said stop valve means in said second position as long as said ram is not lifted from the member to be driven.

14. A fluid operated ram as defined in claim 11, wherein a cylinder space is formed in said valve slide means coaxially with and communicating with said bore and wherein said valve rod is provided at an end thereof extending into said cylinder space with a piston portion sealingly guided in said cylinder space, and including a cylinder formed in said control housing, a separating piston in said cylinder and dividing said cylinder in said control housing into two compartments, channel means in said valve slide means and said control housing for permanently connecting one of said compartments with said cylinder space, the other of said compartments communicating with said passage means providing communication between said pressure fluid space and said first chamber.

15. A fluid operated ram as defined in claim 14, and including spring means biasing said separating piston in a direction tending to reduce the volume of said one compartment.

16. A fluid operated ram as defined in claim 14, and including a transverse channel formed in said valve slide means and having an inner end communicating with said cylinder space and an outer end, outlet channel means in said control housing permanently providing communication between said outer end of said transverse channel and said tank, said piston portion on said valve rod opening said inner end of said transverse channel only in a predetermined position of said piston portion in said cylinder space.

17. A fluid operated ram as defined in claim 14, and including an adjusting means cooperating with said separating piston for adjusting the maximum stroke of the latter.

18. A fluid operated ram as defined in claim 14, and including passage means for permanently connecting said cylinder space with said tank, and a safety valve in said passage means.

19. A fluid operated ram as defined in claim 14, wherein an annular shoulder is formed at the junction of said cylinder space and said bore in said valve slide means, and wherein said valve rod, said cylinder in said control housing and the stroke of the separating piston therein are dimensioned in such a manner that when the piston portion of the valve rod abuts during its downward stroke against said shoulder, said valve slide means is moved to its second position in which said first chamber is connected to said tank.

20. A fluid operated ram for driving a member into the ground, comprising an upright housing having an axis; a striker body guided in said housing for reciprocation along said axis between an active stroke and a return stroke; an impact transmitter arranged between said striker body and said member to drive the member into the ground upon striking of the striker body; a cylinder disposed at the upper end of the housing coaxially therewith; a working piston reciprocably arranged in said cylinder and dividing the latter in a first and a second chamber; a piston rod connecting said working piston to said striker body for simultaneous movement in axial direction; first passage means for connecting said first and said second chamber to a source of pressure fluid and second passage means for connecting said first chamber to a fluid receiving space; control means comprising valve slide means cooperating with said first and second passage means and being movable coaxial with said piston rod between a first position connecting at least one chamber to said first passage means and a second position connecting said first chamber to said second passage means, said valve slide means being formed with an axial bore having an open end facing said working piston, and a blind end; biasing means for permanently urging said valve slide means to said second position; means for moving said valve slide means to said first position against said biasing means in dependence on the position of the striker body relative to said housing and comprising a valve rod axially guided in said bore of said valve slide means and having a free end projecting into said first chamber and a second end permanently disposed in said blind-ended axial bore within said valve slide means; means for permanently biasing said valve rod in the direction toward said working piston, and means for limiting axial movement of said valve slide means and said valve rod relative to each other, said working piston having a contact face opposite said free end of said valve rod, the valve rod having a length which is adjusted so that said free end abuts against said contact face when said striker body is spaced at least a predetermined distance from said impact transmitter, and is disengaged from said contact face when the striker body is spaced from said impact transmitter less than said predetermined distance.

21. A fluid operated ram as defined in claim 20, and including plunger means coaxially mounted in said working piston for limited movement in axial direction, spring means biasing said plunger means in a direction so that an end of the latter provided with said contact face projects into said first chamber to be engaged by the free end of said valve rod.

22. A fluid operated ram as defined in claim 21, wherein said contact face and said free end of said valve rod are constructed as part-spherical faces.

23. A fluid operated ram for driving a member into the ground, comprising an upright housing having an axis; a striker body guided in said housing for reciprocation along said axis between an active stroke and a return stroke; an impact transmitter between said striker body and the member to be driven into the ground upon striking of the striker body against said impact transmitter; a cylinder disposed at the upper end of the housing coaxially therewith; a working piston reciprocably arranged in said cylinder and dividing the latter into a first and a second chamber; a piston rod connecting said working piston with said striker body for simultaneous movement in axial direction; first passage means for connecting said first and second chamber with a source of pressure fluid and second passage means for connecting said first chamber to a space for released fluid; control means comprising valve slide means cooperating with said first and second passage means and being movable coaxial with said piston rod between a first position connecting at least one chamber with said first passage means and a second position connecting said first chamber with said second passage means, said valve slide means being formed with an axial bore having an open end facing said working piston; means for moving said valve slide means to said second position in dependence on the position of the striker body relative to said housing and comprising a valve rod axially guided in said bore of said valve slide means and having an end portion projecting into said first chamber, means cooperating with said valve rod for biasing the same toward said working piston, and means for limiting axial movement of said valve slide means and said valve rod relative to each other, said valve rod having a free end in said first chamber and said working piston having a contact face opposite said free end of said valve rod, the valve rod having a length adjusted so that when said striker body during its active stroke is spaced at least a predetermined distance from said impact transmitter, said free end of said valve rod abuts against said contact face and when the striker body is spaced from said impact transmitter a distance smaller than said predetermined distance, said free end of said valve rod is disengaged from said contact face; and including a pressure fluid accumulator communicating with said first chamber.

24. A fluid operated ram for driving a member into the ground, comprising an upright housing having an axis; a striker body guided in said housing for reciprocation along said axis between an active stroke and a return stroke; an impact transmitter between said striker body and the member to be driven into the ground upon striking of the striker body against said impact transmitter; a cylinder disposed at the upper end of the housing coaxially therewith; a working piston reciprocably arranged in said cylinder and dividing the latter into a first and a second chamber; a piston rod connecting said working piston with said striker body for simultaneous movement in axial direction; first passage means for connecting said first and second second chamber with a source of pressure fluid and second passage means for connecting said first chamber to a spacer for released fluid; control means comprising valve slide means cooperating with said first and second passage means and being movable coaxial with said piston rod between a first position connecting at least one chamber with said first passage means and a second position connecting said first chamber with said second passage means, said valve slide means being formed with an axial bore having an open end facing said working piston; means for moving said valve slide means to said second position in dependence on the position of the striker body relative to said housing and comprising a valve rod axially guided in said bore of said valve slide means and having an end portion projecting into said first chamber, means cooperating with said valve rod for biasing the same toward said working piston, and means for limiting axial movement of said valve slide means and said valve rod relative to each other, said valve rod having a free end in said first chamber and said working piston having a contact face opposite said free end of said valve rod, the valve rod having a length adjusted so that when said striker body during its active stroke is spaced at least a predetermined distance from said impact transmitter, said free end of said valve rod abuts against said contact face and when the striker body is spaced from said impact transmitter a distance smaller than said predetermined distance, said free end of said valve rod is disengaged from said contact face; and including an element cooperating with a lifting device for lifting said ram and holding said valve slide means in said second position, if said ram is lifted from the member to be driven.

* * * * *